United States Patent [19]

Broccoli

[11] Patent Number: 4,832,232

[45] Date of Patent: May 23, 1989

[54] SPRAY GUN VENT

[76] Inventor: Anthony B. Broccoli, 25 Water St., Johnston, R.I. 02919

[21] Appl. No.: 179,497

[22] Filed: Apr. 8, 1988

[51] Int. Cl.[4] ..... B67D 5/00

[52] U.S. Cl. ..... 222/188; 222/442; 239/318

[58] Field of Search ..... 239/124, 318, 347, DIG. 14; 220/308, 309; 222/188, 387, 442, 479–481

[56] References Cited

U.S. PATENT DOCUMENTS

| | | | |
|---|---|---|---|
| 863,648 | 8/1907 | Ritz | 222/481 |
| 2,156,313 | 5/1939 | Schwab | 222/188 X |
| 3,167,221 | 1/1965 | Feinstein et al. | 222/481 |
| 3,456,647 | 7/1969 | Wada | 222/479 X |
| 4,361,257 | 11/1982 | Stone | 222/481 X |

*Primary Examiner*—Andres Kashnikow
*Assistant Examiner*—Kevin P. Weldon
*Attorney, Agent, or Firm*—Felfe & Lynch

[57] ABSTRACT

A spray gun vent for a pressurized paint-spray gun apparatus includes a base insertable into a paint container and having an elongated stem thereon. The base and the stem have a longitudinal passage therethrough. A cover is attached to the base and has a longitudinal passage therethrough and approximately aligned with the passage through the base and the stem. A splash shield is mounted in the cover between the passage and the cover and the passage and the stem for blocking paint flow between the passages while allowing air communication between the atmosphere and the paint container.

8 Claims, 2 Drawing Sheets

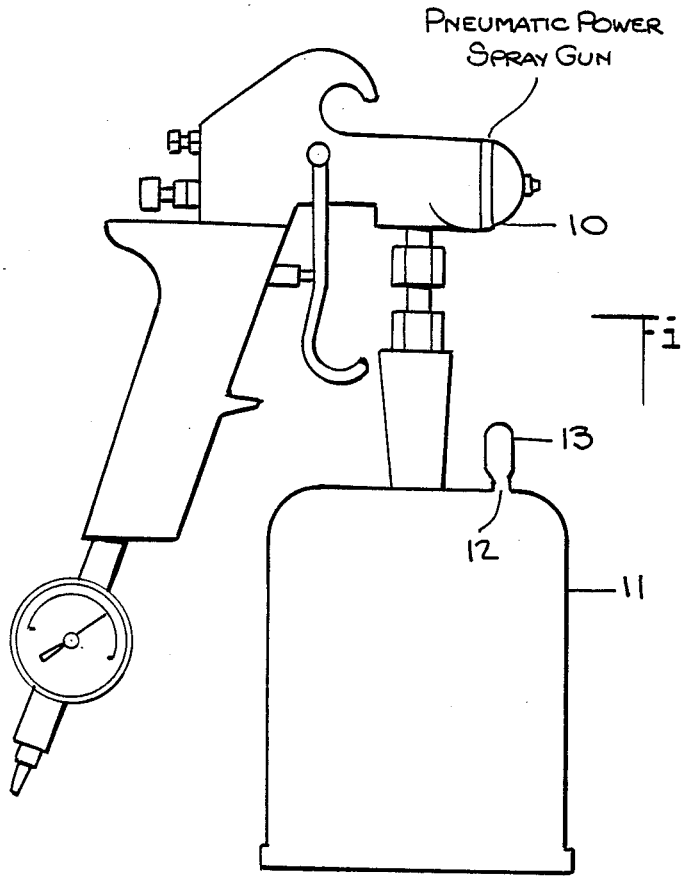
Fig. 1.
Fig. 6.
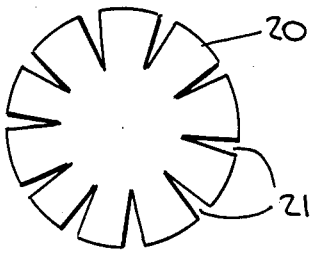
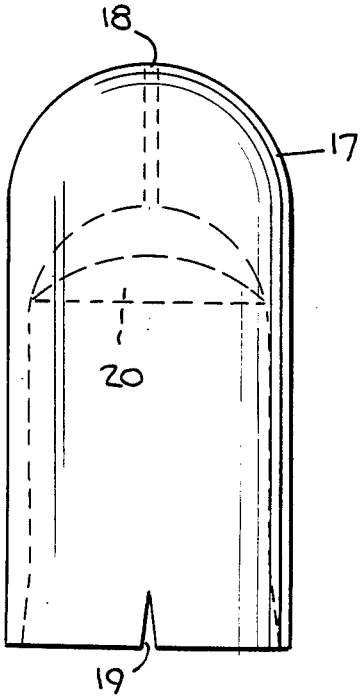
Fig. 7.

SPRAY GUN VENT

This invention relates to a spray gun vent for liquid-spray gun apparatus, and more particularly to a spray gun vent for paint-spray gun apparatus.

U.S. Pat. No. 3,157,360—Heard shows a vent 49 for pressurized spray gun apparatus of the siphon type, which is subject to the limitation that paint will drip from the vent 49 when the spray gun is tilted during use.

U.S. Pat. No. 820,784—Harcourt, U.S. Pat. No. 2,021,004—Garrido, Pat. No. 2,631,758—Gessler and U.S. Pat. No. 2,752,076—Locker relate to the dispensing art. The Harcourt patent has a shield F and a deflecting plate H to prevent accidental splashing of oil against a cork D and accidentally forcing the cork from its seat. However, the shield F has a central opening G for pouring oil through openings I'. The Garrido patent relates to a sugar or the like dispenser. The Gessler patent relates to a measuring cap construction for receptacles for dispensing measured quantities of dry fluid material. The Locker patent relates to apparatus for delivering measured volumetric quantities of granular, pulverulent and like fluent solid materials.

Heretofore, in liquid-spray gun apparatus and in particular pressurized paint-spray gun apparatus of the siphon type, it is common that paint drips from the vent in the paint container during spraying upon tilting of the spray gun and container. The dripping ordinarily occurs through the vent in the paint container both during and after use of the spray gun apparatus.

It is an object of the present invention, therefore, to provide a new and improved spray gun vent for liquid-spray gun apparatus which avoids one or more of the disadvantages and limitations of prior such vents.

It is another object of the invention to provide a new and improved spray gun vent for pressurized paint-spray apparatus of the siphon type which prevents dripping from the vent during use.

In accordance with the invention, a spray gun vent for liquid-spray gun apparatus comprises a base insertable into a liquid container and having an elongated stem thereon. The base and the stem have a longitudinal passage extending therethrough. The vent includes a cover attached to the base and having a longitudinal passage extending therethrough and approximately aligned with the passage through the base and the stem. The vent also includes splash shield means mounted in the cover between the passage in the cover and the passage in the stem for blocking liquid communication between the passages while allowing air communication between the atmosphere and the liquid container.

For a better understanding of the present invention, together with other and further objects thereof, reference is made to the following description, taken in connection with the accompanying drawings, and its scope will be pointed out in the appended claims.

Referring now to the drawings:

FIG. 1 is a diagrammatic view of liquid-spray gun apparatus including a spray gun vent constructed in accordance with the invention;

FIG. 6 is a top plan view of a splash shield of the FIG. 2 vent; and

FIG. 7 is a side elevational view of a cover of the FIG. 2 vent with the splash shield disposed therein.

Referring now more particularly to FIG. 1 of the drawings, a pneumatic power spray gun utilizing pressurized air is diagrammatically represented. The spray gun apparatus includes a liquid container 11 ordinarily for paint. The paint container 11 has a vent aperture 12 therein into which the spray gun vent of the invention may be threaded. The spray gun apparatus preferably is of the siphon type, for example, the type represented in Heard U.S. Pat. No. 3,157,360.

Figure 2:
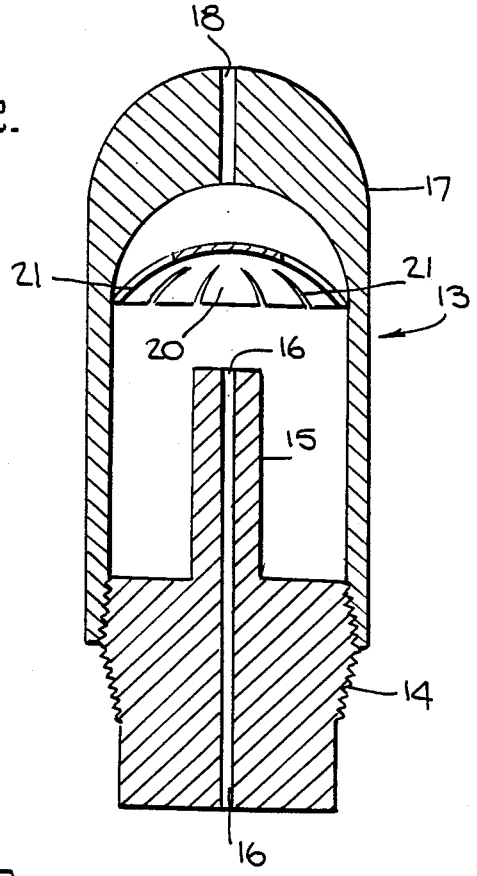
FIG. 2 is a cross-sectional view, to an enlarged scale, of a spray gun vent constructed in accordance with the invention.

Referring now more particularly to FIG. 2 of the drawings, the spray gun vent comprises a base 14 insertable into the liquid container 11 of FIG. 1 and having an elongated stem 15 thereon. The base and the stem have a longitudinal passage 16 extending therethrough. The base 14 is preferably threaded for screwing into the container 11. The stem 15 may, for example, be of $\frac{3}{8}$ inch length.

Figure 3:
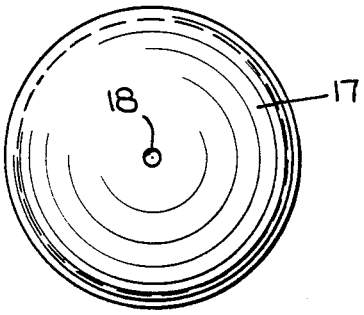
FIG. 3 is a top plan view of the FIG. 2 vent.

The vent also includes a cover 17 attached to the base 14 and having a longitudinal passage 18 extending therethrough and preferably aligned with the passage 16 through the base and the stem. The cover is an elongated hollow cover also represented in FIG. 3, which is a top plan view thereof, and FIG. 7, which is a side elevational view thereof. The cover 17 may be attached to the base by being threaded thereon or by being press fitted thereon. The cover 17 may have longitudinal slots 19 at its bottom around the base as represented in FIG. 7 to aid in fitting the cover to the base. For example, the cover 17 may be of $\frac{1}{2}$ inch diameter and one-inch length.

Figure 4:
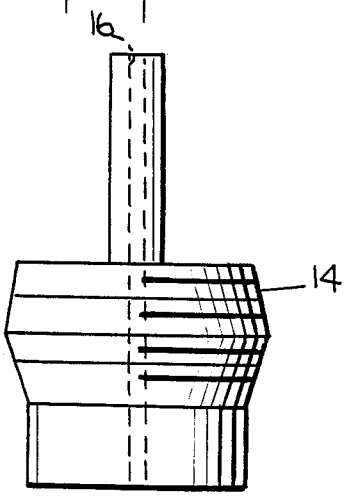
FIG. 4 is a side elevational view of a base and stem of the FIG. 2 spray gun vent.
Figure 5:
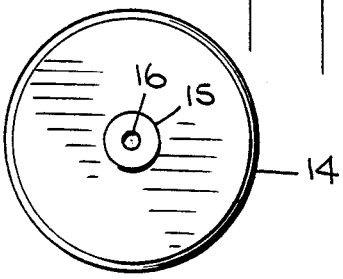
FIG. 5 is a top plan view of the FIG. 4 base and stem.

As represented in FIG. 4, a lower portion of the base may have external threads thereon for screwing into the paint cup aperture. The cover may also have internal threads for screwing onto the upper portion of the base which may also be threaded. FIG. 5 is a top plan view of the base 14 and stem 15.

The spray gun vent also includes splash shield means 20 represented in a top plan view in FIG. 6. The splash shield means 20 is mounted in the cover 17 as represented in FIGS. 2 and 7 and has a slightly curved surface when it is placed in position in the cover 17. The splash shield means is mounted in the cover between the passage 18 in the cover 17 and the passage 16 in the stem 15 for blocking liquid communication between the passages while allowing air communication between the atmosphere and the liquid container. For this purpose, the splash shield preferably comprises a plate 20 having open indentations 21 around the outer edge thereof. The indentations preferably are triangular-shaped for air flow therethrough. The hole in the stem 15 may be slightly larger than the hole 18 in the cover. The hole in the stem is, for example, approximately 1/32 inch diameter.

During operation of the paint-spray gun apparatus, the vent 13 operates as an air inlet into the container 11 to effect a siphon-type operation of the pneumatic, pressurized spray-gun apparatus. In various positions of the apparatus including the horizontal position, paint may flow through the passage 16 of the stem 15 and base 14 and such paint flow is deflected by the splash shield 20 into the region inside the cover around the stem 15. After some period of time the paint may accumulate in the space around the stem 15 to the extent that it flows over the top of the stem 15. The paint will then be drawn by a siphon-type operation through the stem 15 and and passage 16 thereof under atmospheric pressure into the container 11.

I have found that in no operating position of the spray gun apparatus does paint drip from the vent 13.

The vent 13 preferably is removable from the container 11 by, for example, unscrewing the vent with the aid of lacquer thinner, if necessary. Since the spray gun has application in, for example, automobile painting, it is desirable to clean the vent after use by immersion in, for example, lacquer thinner.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A spray gun vent for liquid-spray gun apparatus comprising:

a base insertable into a liquid container and having an elongated stem thereon, said base and said stem having a longitudinal passage extending therethrough;

a cover attached to said base and having a longitudinal passage extending therethrough and approximately aligned with said passage through said base and said stem; and splash shield means mounted in said cover between said passage in said cover and said passage in said stem for blocking liquid communication between said passages while allowing air communication between the atmosphere and said liquid container.

2. A vent in accordance with claim 1 in which said cover is an elongated hollow cover.

3. A vent in accordance with claim 1 in which said splash shield means comprises a plate having open indentations around the outer edge thereof.

4. A vent in accordance with claim 3, in which said indentations are triangular-shaped openings in the plate.

5. A vent in accordance with claim 1 in which said passage in said stem is slightly larger than said passage in said cover.

6. A vent in accordance with claim 1 in which said passage in said stem has a diameter of approximately 1/32 inch.

7. A vent in accordance with claim 1, adapted for use with paint-spray gun apparatus.

8. In combination, liquid-spray gun apparatus and a spray gun vent comprising:

a base insertable into a liquid container and having an elongated stem thereon, said base and said stem having a longitudinal passage extending therethrough;

a cover attached to said base and having a longitudinal passage extending therethrough and aligned with said passage through said base and said stem; and splash shield means mounted in said cover between said passage in said cover and said passage in said stem for blocking liquid communication between said passages while allowing air communication between the atmosphere and said liquid container.

* * * * *